US010830259B1

(12) United States Patent
Brookins

(10) Patent No.: US 10,830,259 B1
(45) Date of Patent: Nov. 10, 2020

(54) SOLENOID HIGH PRESSURE INDEXING VALVE SYSTEM

(71) Applicant: Keith Donald Brookins, Miami, FL (US)

(72) Inventor: Keith Donald Brookins, Miami, FL (US)

( * ) Notice: Subject to any disclaimer, the term of this patent is extended or adjusted under 35 U.S.C. 154(b) by 98 days.

(21) Appl. No.: 16/110,020

(22) Filed: Aug. 23, 2018

(51) Int. Cl.
*F15B 13/08* (2006.01)

(52) U.S. Cl.
CPC ..... *F15B 13/085* (2013.01); *F15B 13/086* (2013.01); *F15B 13/0814* (2013.01); *F15B 13/0835* (2013.01); *F15B 13/0871* (2013.01); *F15B 13/0875* (2013.01)

(58) Field of Classification Search
CPC ..... F15B 13/085; F15B 13/0814; F15B 13/0875; F15B 13/0871; F15B 13/086; F15B 13/0835
See application file for complete search history.

(56) References Cited

U.S. PATENT DOCUMENTS 2,713,900 A 7/1955 Bloom
2,931,387 A * 4/1960 Fleming ..... F16K 11/22 137/883
3,119,170 A 1/1964 Buck
3,504,704 A * 4/1970 Beckett ..... F16K 11/22 137/625.64
5,860,445 A * 1/1999 Yoshimura ..... F15B 13/0402 137/269
5,934,885 A 8/1999 Farrell et al.
7,296,760 B2 11/2007 Alexander et al.
7,726,343 B2 * 6/2010 Shultz ..... F16K 27/003 137/884
2002/0043288 A1 * 4/2002 Seitz ..... F15B 13/0814 137/883

FOREIGN PATENT DOCUMENTS

WO 2006054221 A1 5/2006

* cited by examiner

*Primary Examiner* — Jessica Cahill
*Assistant Examiner* — Patrick C Williams
(74) *Attorney, Agent, or Firm* — Albert Bordas, P.A.

(57) ABSTRACT

A solenoid high pressure indexing valve system, having at least one solenoid manifold assembly with a manifold assembly and a plurality of solenoid valve assemblies; and a power supply assembly. The manifold assembly has a top face, first and second lateral faces, an inlet tube face, and a sensor face. The top face has a plurality of bores having respective valve bases and inlet-outlet passages. The first and second lateral faces each has a plurality of lateral holes. The inlet tube face is opposite to the sensor face and has an inlet hole, and the sensor face has a sensor hole. The manifold assembly further has an inlet passage and a plurality of outlet passages. The manifold assembly further has an inlet tube and a plurality of outlet tubes. The manifold assembly further has a pressure sensor.

13 Claims, 9 Drawing Sheets

SOLENOID HIGH PRESSURE INDEXING VALVE SYSTEM

BACKGROUND OF THE INVENTION

1. Field of the Invention

The present invention relates to high pressure indexing valves, and more particularly, to solenoid high pressure indexing valve systems.

2. Description of the Related Art

Applicant believes that one of the closest references corresponds to U.S. Pat. No. 7,296,760 B2 issued to Alexander, et al. on Nov. 20, 2007 for Indexing valve. However, it differs from the present invention because Alexander, et al. teaches a valve for controlling the flow of a gas or mixture of gases through a passageway in a coating material dispensing device that includes first and second valve portions. The first valve portion is adjustable with respect to the second valve portion selectively to adjust the flow through the passageway. One of the first and second valve portions has a first engagement member and the other of the first and second valve portions has a second engagement member. Engagement of the first and second engagement members indicates the relative orientation of the first and second valve portions.

Applicant believes that another reference corresponds to U.S. Pat. No. 5,934,885 issued to Farrell, et al. on Aug. 10, 1999 for Reagent pump assembly. However, it differs from the present invention because Farrell, et al. teach a reagent pump assembly for metering precise volumes of fluids, such as reagent, for an analytical instrument, such as a clinical hematology or flow cytometer instrument. The assembly has a multilayer block having a plurality of diaphragm pumps interposed between two of the layers, controlled by application of one of vacuum or pressure, in sequence, to fill the reservoirs and expel the contents of the pump. One-way check valves are used to control the fluid flow from the reservoirs of fluids to the fluid outlet ports. The fluid outlet ports may be directly coupled to fluid inlet ports of a compatible unified flow circuit, which contains reaction chambers and a plurality of sample aliquots. The reagent pump assembly can be used to combine and mix sample aliquots with a precise amount of reagent in a reaction chamber, preparatory for analyzing the reaction mixture.

Applicant believes that another reference corresponds to U.S. Pat. No. 3,119,170 issued to William H. Buck, on Jan. 28, 1964 for Turret indexing control device. However, it differs from the present invention because Buck teaches a turret-controlling device for a machine tool and a hydraulic feeding apparatus wherein the relative approach of the work and the tool proceeds at various selected speeds corresponding in a predetermined manner with various positions of a turret.

Applicant believes that another reference corresponds to U.S. Pat. No. 2,713,900 issued to Abe M. Bloom, on Jul. 26, 1955 for Time controlled valve closing mechanism. However, it differs from the present invention because Bloom teaches a device applicable to valves which when allowed to do so automatically close themselves, which can be set so that, after the lapse of a predetermined length of time, means holding the valve associated therewith will be released so that the valve will be maintained in an open condition until the delivery of the amount of fluid, flow of which is controlled by such valve.

Applicant believes that one of the closest references corresponds to WIPO Publication No. WO2006/054221 A1 published on May 26, 2006 to Kevin L. Alexander for Indexing valve. However, it differs from the present invention because Alexander teaches a valve for controlling the flow of a gas or mixture of gases through a passageway in a coating material dispensing device that includes first and second valve portions. The first valve portion is adjustable with respect to the second valve portion selectively to adjust the flow through the passageway. One of the first and second valve portions has a first engagement member and the other of the first and second valve portions includes a second engagement member. Engagement of the first and second engagement members indicates the relative orientation of the first and second valve portions.

Other patents describing the closest subject matter provide for a number of more or less complicated features that fail to solve the problem in an efficient and economical way. None of these patents suggest the novel features of the present invention.

SUMMARY OF THE INVENTION

The present invention is a solenoid high pressure indexing valve system, comprising at least one solenoid manifold assembly comprising a manifold assembly and a plurality of solenoid valve assemblies; and a power supply assembly.

The manifold assembly comprises a top face, first and second lateral faces, an inlet tube face, and a sensor face. The top face comprises a plurality of bores having respective valve bases and inlet-outlet passages. The first and second lateral faces each comprises a plurality of lateral holes. The inlet tube face is opposite to the sensor face and comprises an inlet hole, and the sensor face comprises a sensor hole. The manifold assembly further comprises an inlet passage and a plurality of outlet passages. The manifold assembly further comprises an inlet tube and a plurality of outlet tubes. The manifold assembly further comprises a pressure sensor.

The inlet tube is positioned into the inlet hole, and the pressure sensor is positioned onto the sensor hole. The inlet passage is relatively centered internally through the manifold assembly, extends from the inlet hole to the sensor hole, and comprises input passages.

The plurality of outlet passages are approximately equally spaced apart from each other internally along a length of the manifold assembly, are approximately perpendicular to the inlet passage, and extend from respective the lateral holes. The plurality of outlet tubes is positioned into the plurality of lateral holes respectively. The inlet-outlet passages connect with the input passage and the outlet passages respectively.

The solenoid valve assembly comprises a valve body, a valve head, a valve base, and connectors. The solenoid valve assembly further comprises an interior top wall, a spring, a solenoid coil, and a valve seal. The power supply assembly comprises at least one controller, a power supply, and wires. The plurality of solenoid valve assemblies is mounted onto the manifold assembly, whereby each solenoid valve assembly is placed into each of the bores respectively. Each solenoid valve assembly opens and closes to dispense fluid from the inlet passage to the plurality of outlet passages. The solenoid valve assembly and the pressure sensor are connected to the controller. In a preferred embodiment, a plurality of solenoid manifold assemblies is connected together, whereby a plurality of inlet tubes are parallel and outlet tubes are sequential. It is therefore one of the main objects of the present invention to provide a solenoid high pressure indexing valve system.

It is another object of this invention to provide a solenoid high pressure indexing valve system having a single inlet and multiple outlets.

It is another object of this invention to provide a solenoid high pressure indexing valve system, which has a solenoid valve assembly.

It is another object of this invention to provide a solenoid high pressure indexing valve system, which has multiple solenoid valve assemblies.

It is another object of this invention to provide a solenoid high pressure indexing valve system, which is of a durable and reliable construction.

It is yet another object of this invention to provide a solenoid high pressure indexing valve system that maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
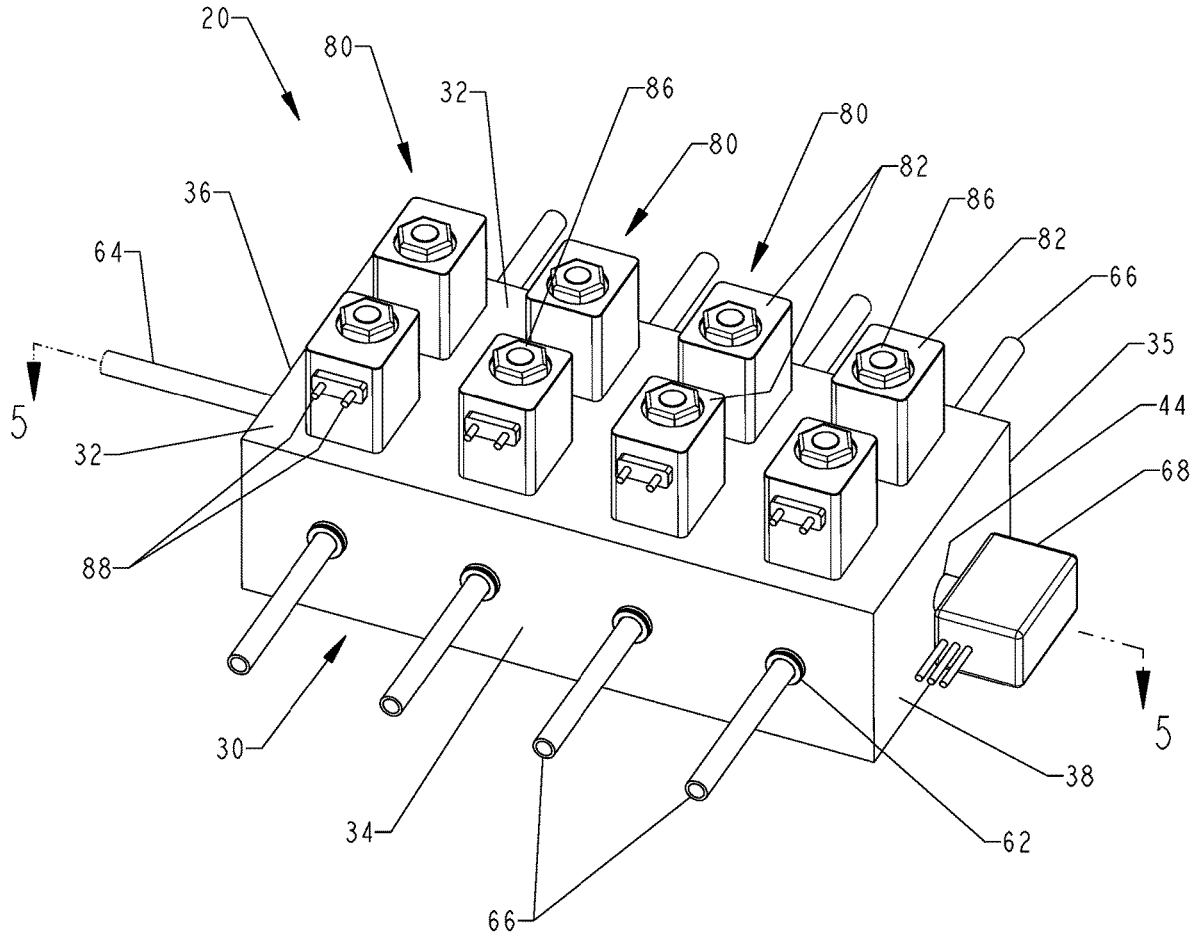
FIG. 1 is a first isometric view of a solenoid manifold assembly of the present invention.

Referring now to the drawings, the present invention is a solenoid high pressure indexing valve system, and is generally referred to with numeral 10. It can be observed that it basically includes at least one solenoid manifold assembly 20 and power supply assembly 120.

Figure 2:
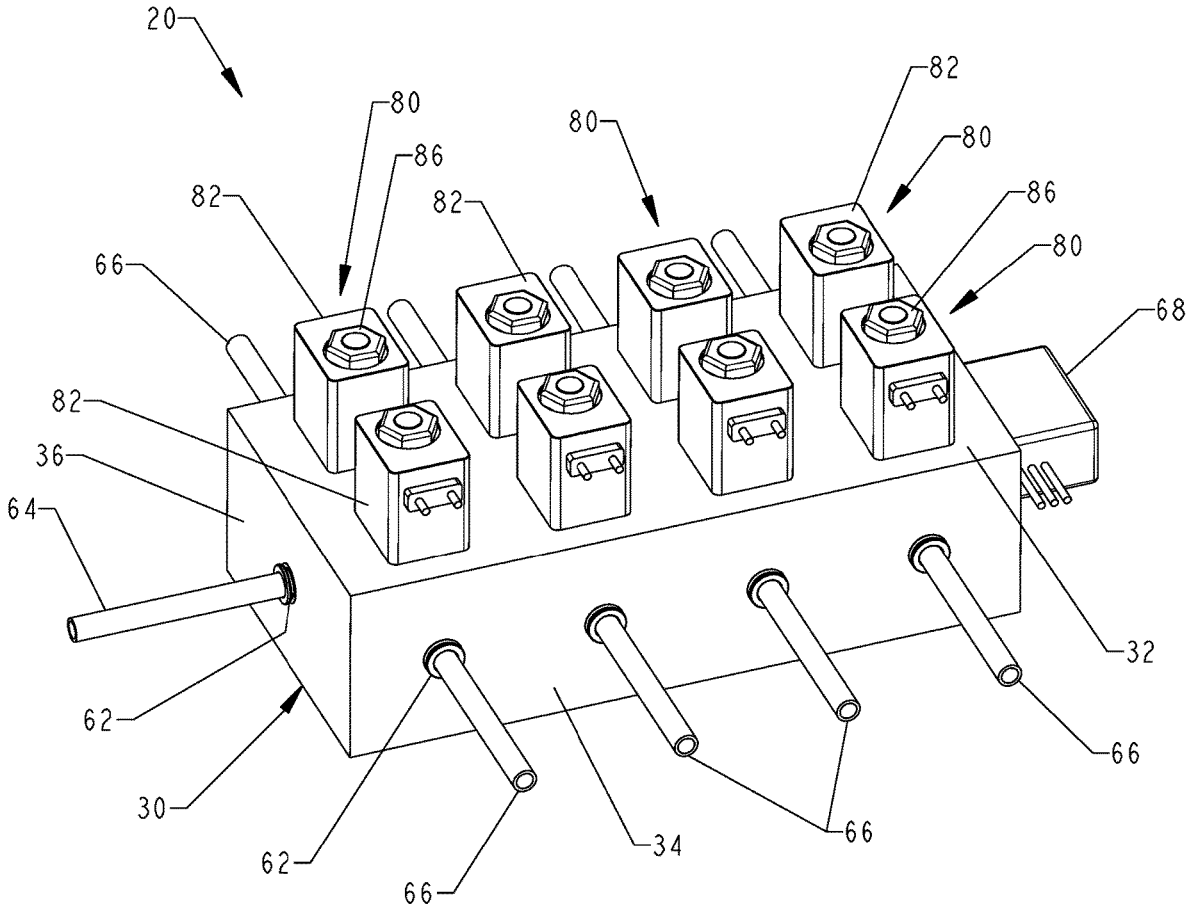
FIG. 2 is a second isometric view of the solenoid manifold assembly of the present invention.

As seen in FIGS. 1 and 2, solenoid manifold assembly 20 comprises manifold assembly 30 and a plurality of solenoid valve assemblies 80. Manifold assembly 30 comprises top face 32, first and second lateral faces 34 and 35, inlet tube face 36, and sensor face 38. Inlet tube face 36 is opposite to sensor face 38. Manifold assembly 30 further comprises pressure sensor 68. In a preferred embodiment, manifold assembly 30 is rectilinear in shape. The shape and features of manifold assembly 30 may change based upon the ultimate or intended method of manufacture, and total number of outlet passages 58 and 60, seen in FIG. 5. These features might include material savers, parting lines, machined surfaces, datum pads for plastic injection molding, metal casting, etc. Solenoid manifold assembly 20 is a fully expandable electro-mechanical pressure-triggered valve with a single inlet tube 64 and multiple outlet tubes 66 used to dispense fluids from a single or centralized fluid supply location to multiple other locations.

Figure 3:
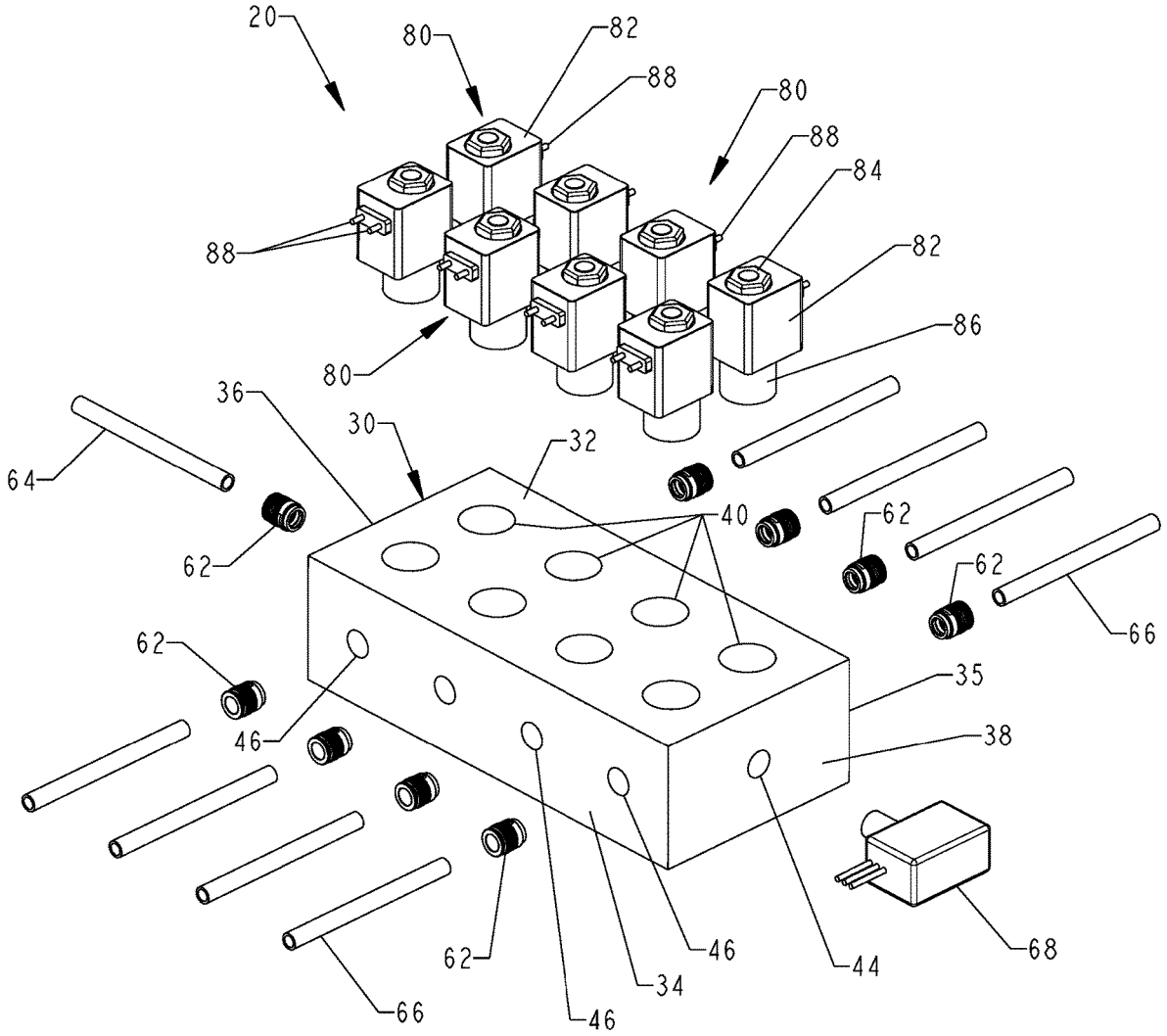
FIG. 3 is an exploded view of the solenoid manifold assembly.

As seen in FIG. 3, top face 32 comprises a plurality of bores 40. In one embodiment, top face 32 comprises eight bores 40 comprising eight solenoid valve assemblies 80 respectively.

Figure 4:
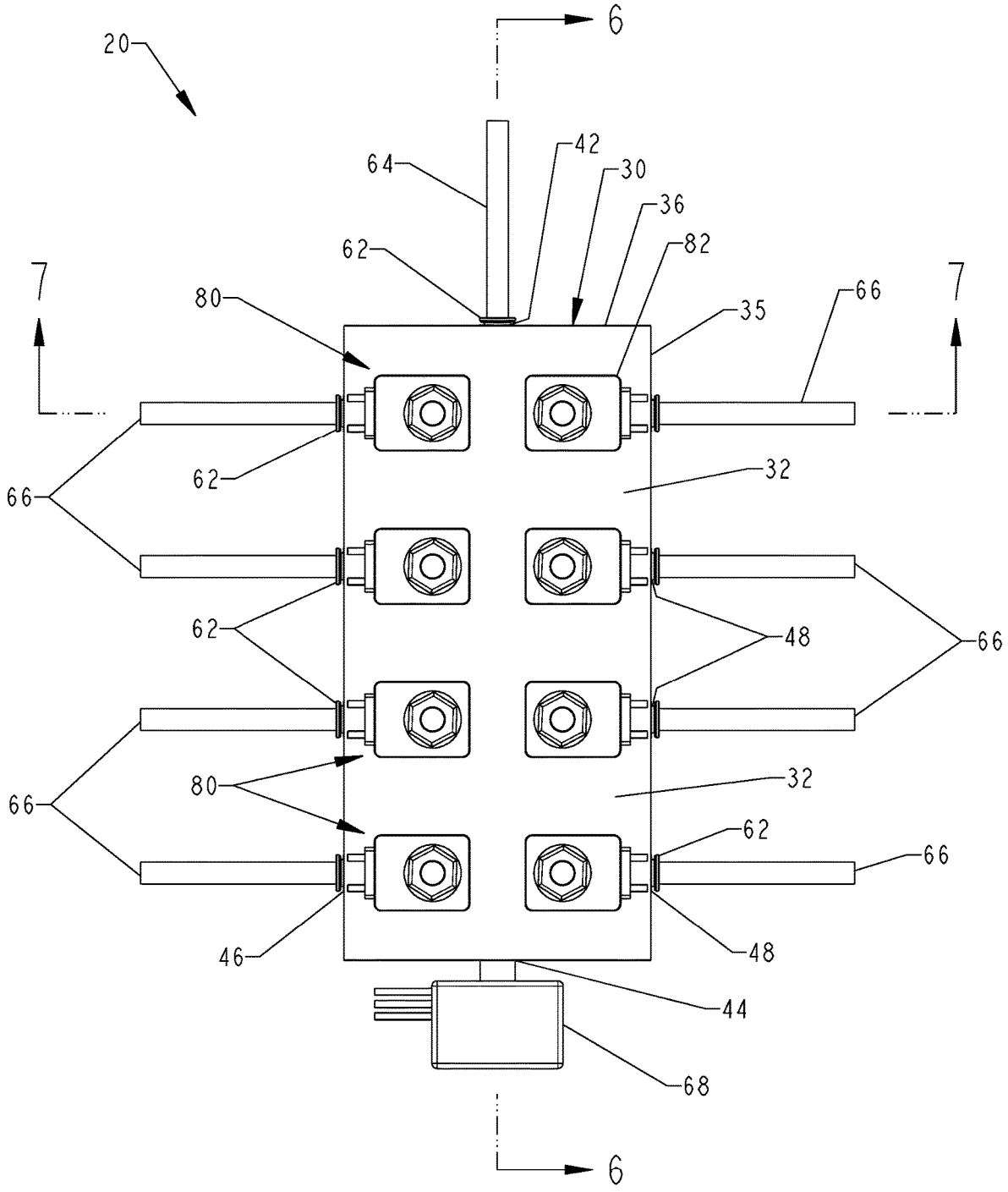
FIG. 4 is a top view of the solenoid manifold assembly.

Inlet tube face 36 comprises inlet hole 42, seen in FIG. 4, and sensor face 38 comprises sensor hole 44. First lateral face 34 comprises a plurality of lateral holes 46, and second lateral face 35 comprises a plurality of lateral holes 48, seen in FIG. 4. In this embodiment, first lateral face 34 comprises four lateral holes 46 and second lateral face 35 comprises four lateral holes 48, as seen in FIG. 4. Manifold assembly 30 further comprises couplings 62. Solenoid valve assembly 80 comprises valve body 82, valve head 84, valve base 86, and connectors 88.

As seen in FIG. 4, solenoid valve assemblies 80 are mounted onto manifold assembly 30. Manifold assembly 30 further comprises inlet tube 64, and a plurality of outlet tubes 66. Inlet tube 64 is positioned into inlet hole 42 with coupling 62, and pressure sensor 68 is positioned into sensor hole 44 at an opposite end. The features required to attach coupling 62 and pressure sensor 68 reside at their respective ends. Outlet tubes 66 are positioned on lateral holes 46 and 48 respectively with couplings 62. The features required to attach couplings 62 reside at each of respective lateral holes 46 and 48.

Figure 5:
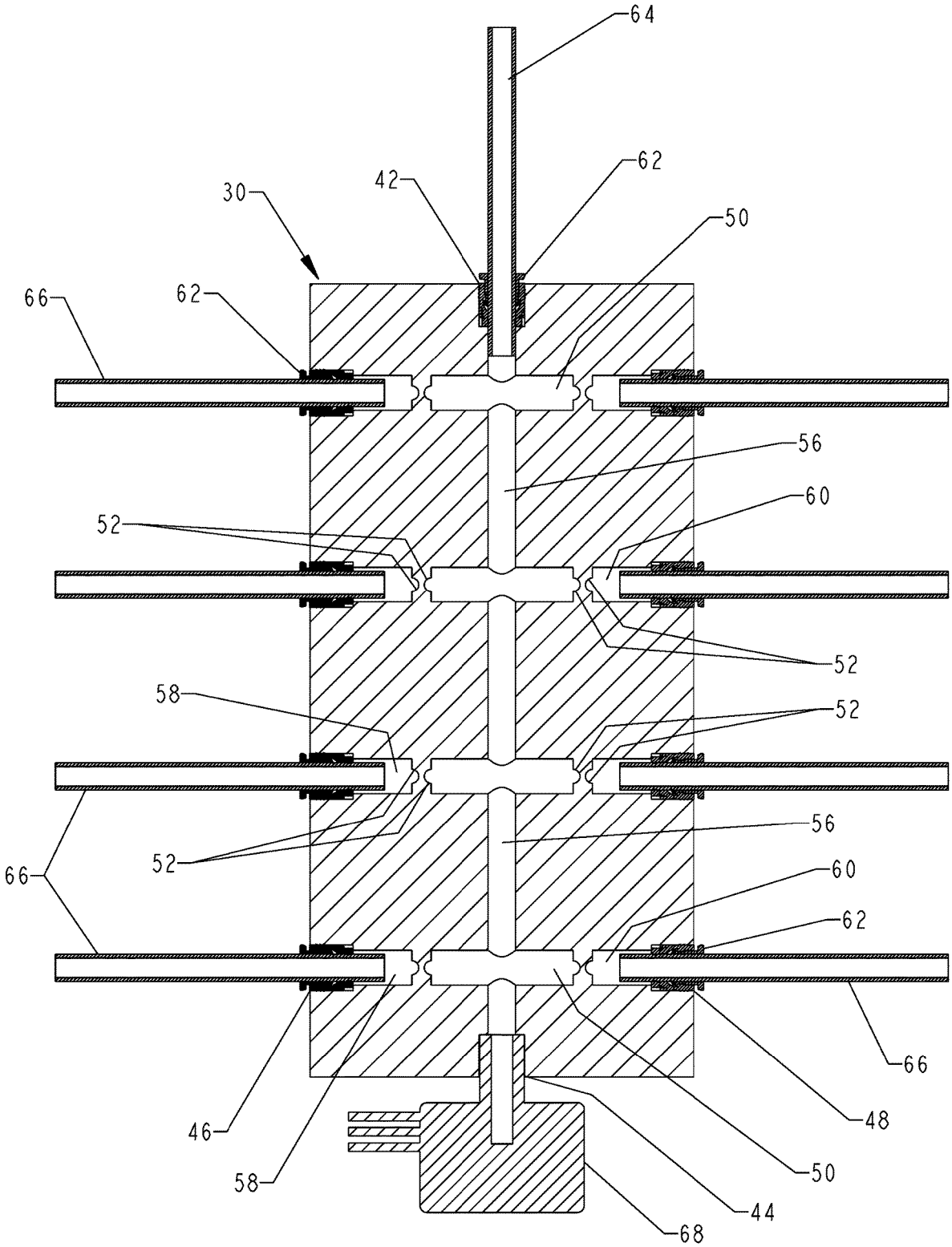
FIG. 5 is a cut view of the solenoid manifold assembly taken along lines 5-5 as seen FIG. 1.
Figure 6:
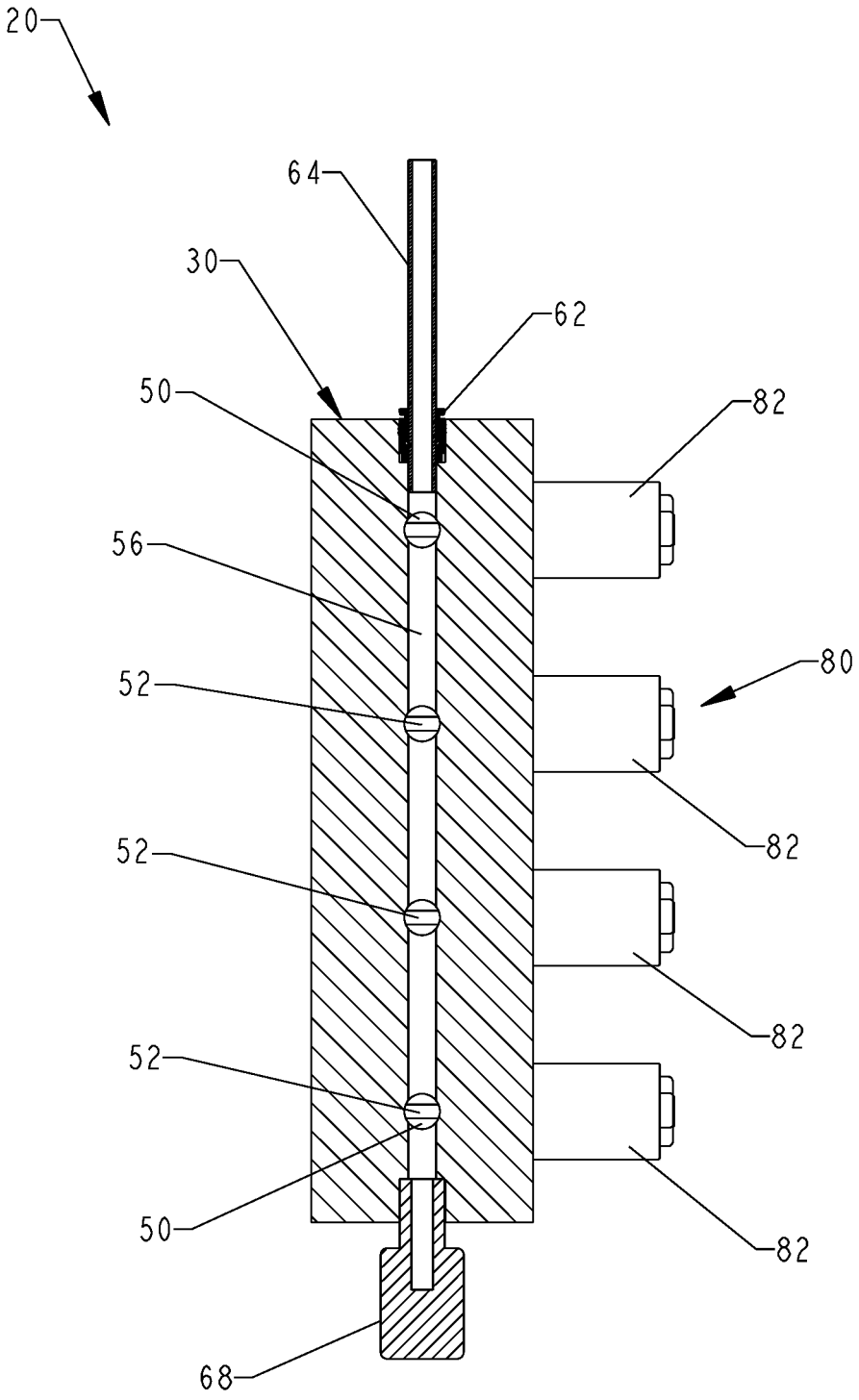
FIG. 6 is a cut view of the solenoid manifold assembly taken along lines 6-6 as seen in FIG. 4.

As seen in FIGS. 5 and 6, manifold assembly 30 further comprises inlet passage 56 and a plurality of outlet passages 58 and 60. Inlet passage 56 and outlet passages 58 and 60 are punctured in manifold assembly 30 to provide connections for fluid between different areas of manifold assembly 30. Inlet passage 56 is relatively centered internally through manifold assembly 30 and extends from inlet hole 42 to sensor hole 44. Inlet passage 56 comprises input passages 50. In a preferred embodiment, an array of orthogonal segmented intersecting outlet passages 58 and 60 are drilled in manifold assembly 30. Outlet passages 58 and 60 are equally spaced internally along the length of manifold assembly 30 and are perpendicular to inlet passage 56. Outlet passages 58 and 60 end on respective lateral holes 46 and 48. Solenoid manifold assembly 20 may function in any orientation as solenoid valve assemblies 80 are not sensitive to small pressure differentials, for example, due to distance between inlet hole 42 and far-most outlet passages 58 and 60, as the input pressure is of a magnitude higher than the differential pressures between inlet passage 56 and solenoid valve assembly 80.

Figure 7:
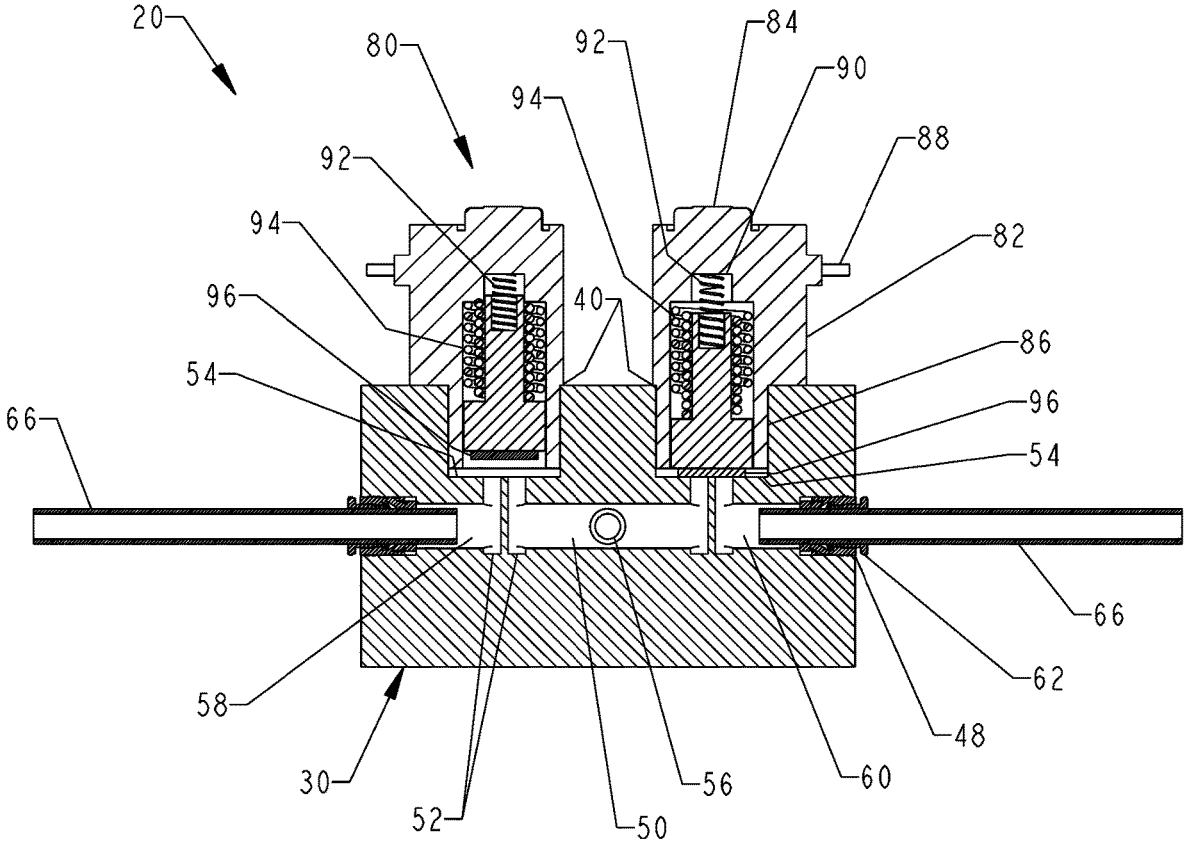
FIG. 7 is a cut view of the solenoid manifold assembly taken along lines 7-7 as seen in FIG. 4.

As seen in FIG. 7, each solenoid valve assembly 80 further comprises interior top wall 90, spring 92, solenoid coil 94, and valve seal 96. Bores 40 comprise valve base 54 and inlet-outlet passages 52. Bores 40 and inlet-outlet passages 52 are drilled into manifold assembly 30 to attach and engage solenoid valve assemblies 80. Inlet-outlet passages 52 are connected with input passages 50 and respective outlet passages 58 or 60. Present invention 10 uses the plurality of solenoid valve assemblies 80 mounted onto manifold assembly 30 to dispense fluid from inlet passage 56 to the plurality of outlet passages 58 and 60.

Figure 8:
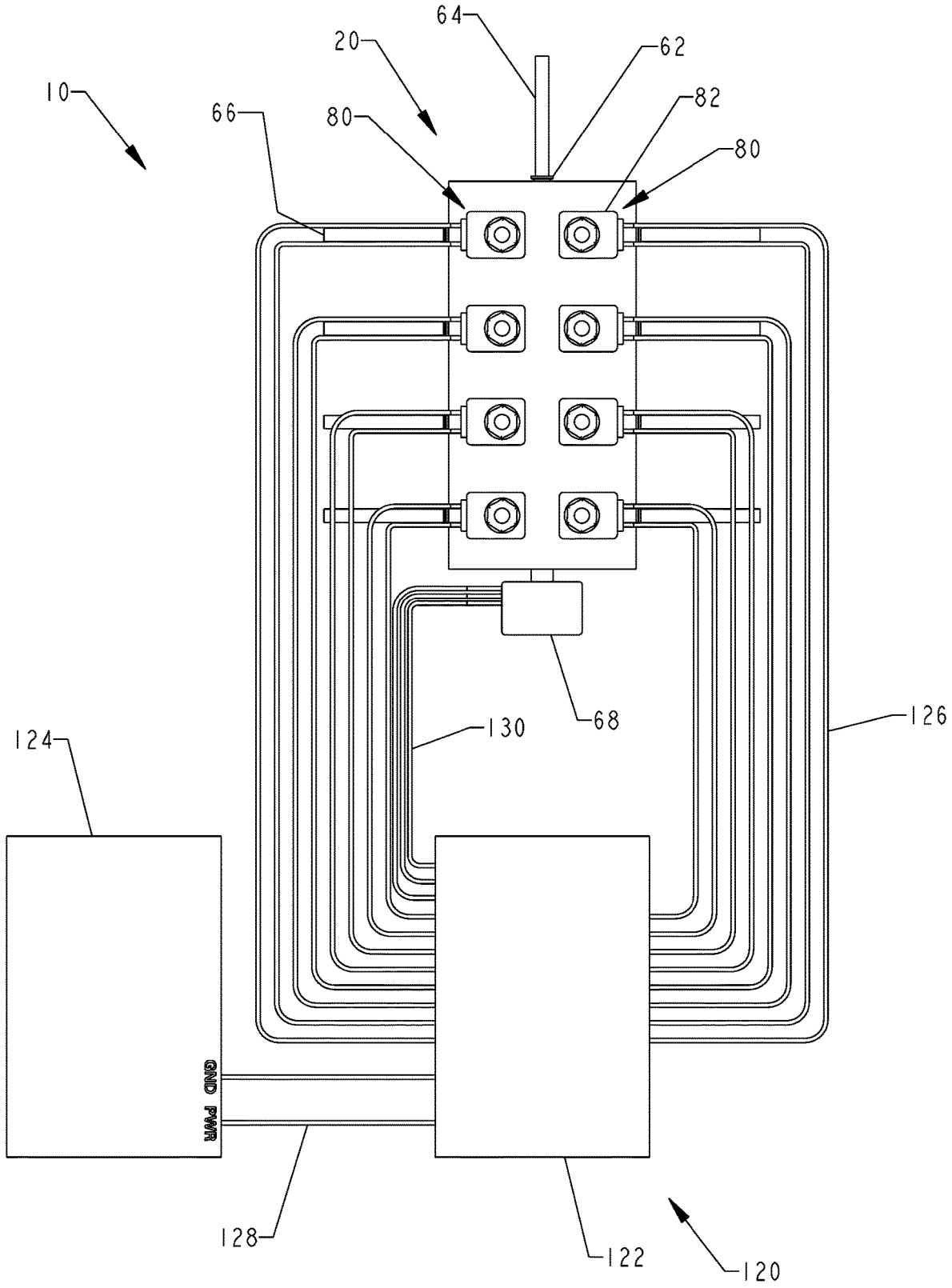
FIG. 8 is a top view of the present invention.

As seen in FIG. 8, power supply assembly 120 comprises at least one controller 122, power supply 124, and wires 126, 128 and 130. Each solenoid valve assembly 80 and pressure sensor 68 are connected to controller 122. Wires 126 connect each solenoid valve assembly 80 to controller 122. Wires 128 connect controller 122 to power supply 124. Wires 130 connect pressure sensor 68 to controller 122. A default state of entire solenoid manifold assembly 20 is closed. Solenoid valve assembly 80 is spring-biased in a normally closed state and only opens when a voltage differential is applied across connectors 88, as seen in FIG. 1. Controller 122 manages the sequence in which each solenoid valve assembly 80 is opened/closed.

Power supply 124 provides sufficient voltage and current capacity to operate controller 122. Power supply 124 may be any power source such as, but not limited to, in the form of an AC line, DC battery, solar, etc., depending on size constraints of controller 122. In another embodiment, power supply 124 might be integrated directly into controller 122. In one embodiment, present invention 10 comprises a single solenoid manifold assembly 20 connected to controller 122 and power supply 124. In this embodiment, upon actuation of a remotely located pump or pressure source, pressure sensor 68 senses either a rise or fall in pressure and then signals controller 122 to open a next solenoid valve assembly 80 in sequence.

Figure 9:
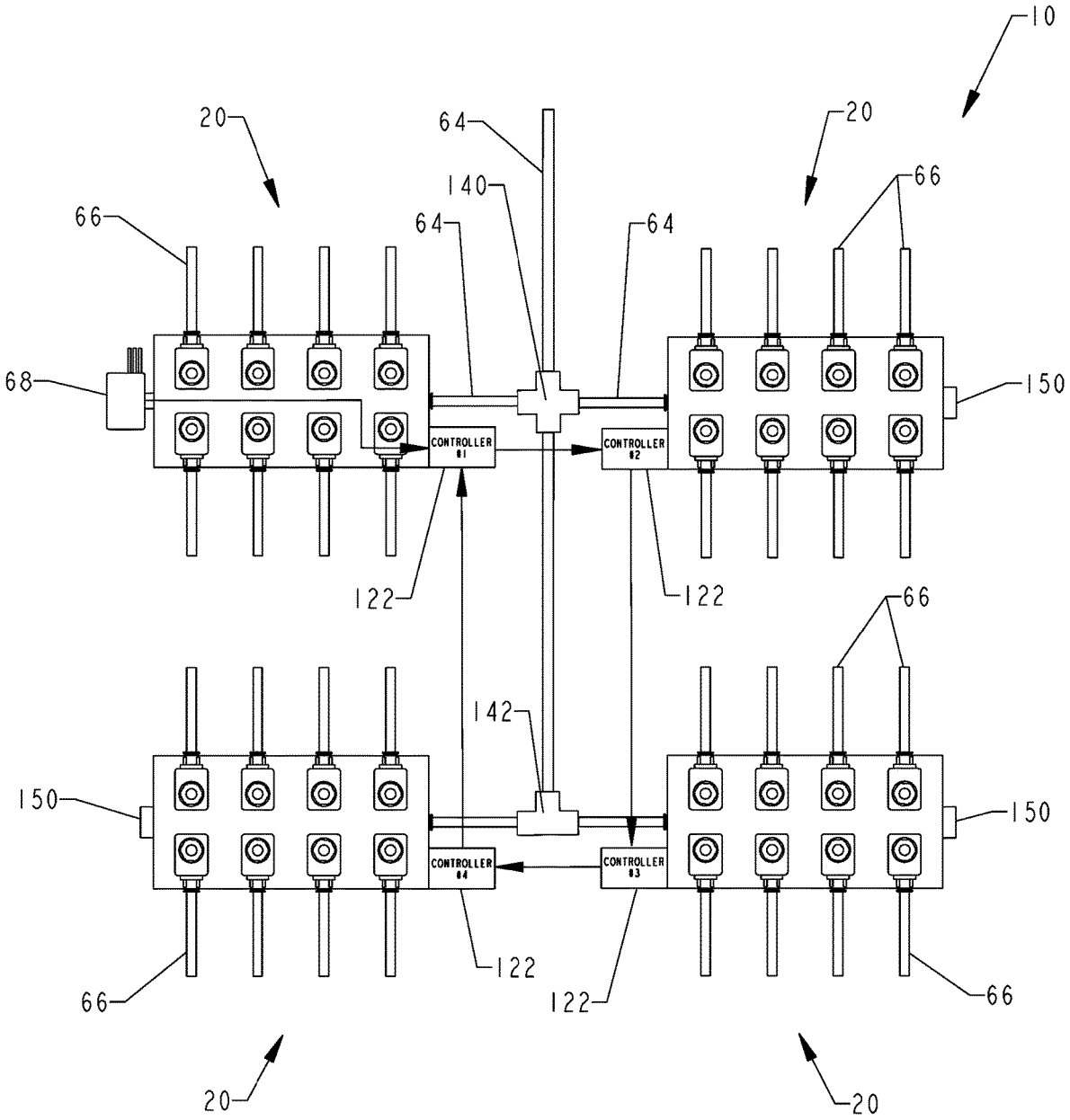
FIG. 9 is a top view of present invention with four solenoid manifold assemblies.

As seen in FIG. 9, in another embodiment, a plurality of solenoid manifold assemblies 20 may be connected together, whereby inlet tubes 64 are parallel while outlet tubes 66 are sequential. In the illustrated embodiment, present invention 10 comprises four solenoid manifold assemblies 20 with eight outlet tubes 66 per manifold assembly 30. One solenoid manifold assembly 20 can be used as a master solenoid valve assembly 20, and additional solenoid manifold assemblies 20 would be designated as slave solenoid valve assemblies 20. Pressure sensor 68 is connected to the master solenoid valve assembly 20 and plugs 150 are positioned on remaining sensor holes 44 to obstruct the flow of fluid in the remaining three slave solenoid valve assemblies 20. Multiples solenoid manifold assemblies 20 may be connected together, but only the master solenoid manifold assembly 20 needs pressure sensor 68, and the remaining slave solenoid manifold assemblies 20 use plug 150 in place of pressure sensor 68.

In operation, an overall cycle begins at the master solenoid valve assembly 20. After a master controller 122 cycles through all of solenoid valve assemblies 80 in respective manifold assembly 30, the master controller 122 will pass control to the first slave controller 122 and then cycle through its respective solenoid valve assembly 80. After all of the slave controllers 122 cycle through their own arrays of solenoid valve assemblies 80, control will be passed from the last slave controller 122 back to the master controller 122 and the overall cycle will repeat. The pressure that triggers controller 122 to open solenoid valve assemblies 80 comes from a remotely located pump or other pressure source. Present invention 10 may work at high or low pressures. However, in a preferred embodiment, present invention 10 is a high pressure/low volume system. Additional slave solenoid manifold assemblies 20, each with their own slave controller 122, may be added to present invention 10 by teeing into supply inlet tube 64. Additional inlet tubes 64 may be connected by 4-way coupling 140 and T-way coupling 142.

Each solenoid manifold assembly 20 requires its own controller 122 to sequence each solenoid valve assembly 80. Wires 126, 128, and 130, as seen in FIG. 8, are required to provide power to slave controllers 122. The optimal configuration for system layout would be to maintain close proximity for all of solenoid manifold assemblies 20. In a preferred embodiment, present invention 10 serves as a delivery system in general for hydraulics and pneumatics, and particularly for misters, foggers, spray systems, and the like. Present invention 10 creates multiple sequential pathways without significant loss, and is exponentially expandable.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A solenoid high pressure indexing valve system, comprising:

A) at least one solenoid manifold assembly comprising a manifold assembly and a plurality of solenoid valve assemblies, said manifold assembly comprises a top face, first and second lateral faces, an inlet tube face, and a sensor face opposite said inlet tube face, each of said first and second lateral faces comprises a plurality of lateral holes, said top face comprises a plurality of bores having respective valve bases and inlet-outlet passages, each inlet-outlet passage having vertical recesses that are connected with respective input passages and respective outlet passages, each said solenoid valve assembly comprises an interior top wall, a spring, a solenoid coil, and a valve seal, said sensor face comprising a sensor hole having a pressure sensor; and B) a power supply assembly.

2. The solenoid high pressure indexing valve system set forth in claim 1, further characterized in that said inlet tube face comprises an inlet hole.

3. The solenoid high pressure indexing valve system set forth in claim 2, further characterized in that an inlet passage is relatively centered internally through said manifold assembly, extends from said inlet hole to said sensor hole, and comprises said input passages.

4. The solenoid high pressure indexing valve system set forth in claim 3, further characterized in that said outlet passages are equally spaced apart from each other internally along a length of said manifold assembly, are perpendicular to said inlet passage, and extend from respective said lateral holes.

5. The solenoid high pressure indexing valve system set forth in claim 3, further characterized in that each said solenoid valve assembly opens and closes to dispense fluid from said inlet passage to said plurality of outlet passages.

6. The solenoid high pressure indexing valve system set forth in claim 1, further characterized in that said manifold assembly further comprises an inlet tube and a plurality of outlet tubes.

7. The solenoid high pressure indexing valve system set forth in claim 6, further characterized in that said inlet tube is positioned into said inlet hole.

8. The solenoid high pressure indexing valve system set forth in claim 6, further characterized in that said plurality of outlet tubes are positioned into said plurality of lateral holes respectively.

9. The solenoid high pressure indexing valve system set forth in claim 6, further characterized in that a plurality of said solenoid manifold assemblies are connected together, whereby a plurality of inlet tubes including said inlet tube are parallel and said plurality of outlet tubes are sequential.

10. The solenoid high pressure indexing valve system set forth in claim 1, further characterized in that each said solenoid valve assembly comprises a valve body, a valve head, a valve base, and connectors.

11. The solenoid high pressure indexing valve system set forth in claim 1, further characterized in that said power supply assembly comprises at least one controller, a power supply, and wires.

12. The solenoid high pressure indexing valve system set forth in claim 11, further characterized in that each said solenoid valve assembly and said pressure sensor are connected to said controller.

13. The solenoid high pressure indexing valve system set forth in claim 1, further characterized in that said plurality of solenoid valve assemblies are mounted onto said manifold assembly, whereby each said solenoid valve assembly is placed into each of said bores respectively.

* * * * *